United States Patent [19]

Kobayashi

[11] Patent Number: 4,969,575

[45] Date of Patent: Nov. 13, 1990

[54] TISSUE PAPER CASE HAVING AN INCLINED LID MEMBER WITH CONCAVE UNDERCUT PORTIONS TO GUIDE THE FINGERS OF A USER

[76] Inventor: Minako Kobayashi, 12-7, Oizumigakuen 6-chome, Nerima-ku, Tokyo, Japan

[21] Appl. No.: 371,672

[22] Filed: Jun. 23, 1989

Related U.S. Application Data

[63] Continuation of Ser. No. 101,200, Sep. 25, 1987.

[30] Foreign Application Priority Data

Oct. 8, 1986 [JP] Japan ..... 61-153634

[51] Int. Cl.[5] ..... A47K 10/42

[52] U.S. Cl. ..... 221/45; 221/52; 221/63

[58] Field of Search ..... 221/45, 46; 220/200; 215/316, 200; 248/DIG. 7

[56] References Cited

U.S. PATENT DOCUMENTS

| | | | |
|---|---|---|---|
| 570,859 | 11/1896 | Weigand | 221/279 |
| 813,594 | 2/1906 | Sexton | 221/52 |
| 1,331,112 | 2/1920 | Lazar | 221/51 |
| 1,507,106 | 9/1924 | Cohn | 221/49 X |
| 1,525,040 | 2/1925 | Painter | 221/63 X |
| 1,665,628 | 4/1928 | Hunt | 221/56 |
| 1,874,642 | 8/1932 | Shaffer et al. | 221/56 X |
| 2,027,671 | 1/1936 | Broeren | 221/59 |
| 2,082,765 | 6/1937 | Krueger | 221/52 X |
| 2,580,982 | 1/1952 | Weiss | 221/61 X |
| 2,801,039 | 7/1957 | Arneson | 220/200 X |
| 2,849,152 | 8/1958 | Tuttle | 221/48 |
| 3,067,905 | 12/1962 | Ehret | 220/200 |
| 3,214,227 | 10/1965 | Filipowicz | 221/59 X |
| 3,446,395 | 5/1969 | Ballin | 221/52 |
| 4,185,753 | 1/1980 | Leto | 221/45 |
| 4,243,153 | 1/1981 | Mitchell | 221/45 X |

FOREIGN PATENT DOCUMENTS

| | | | |
|---|---|---|---|
| 1023707 | 1/1978 | Canada | 221/48 |
| 458055 | 9/1925 | Fed. Rep. of Germany | 221/52 |
| 2362610 | 4/1978 | France | 221/52 |
| 59-105404 | 6/1984 | Japan . | |
| 24066 | of 1904 | United Kingdom | 221/52 |

*Primary Examiner*—Andres Kashnikow
*Assistant Examiner*—Kenneth DeRosa
*Attorney, Agent, or Firm*—Wenderoth, Lind & Ponack

[57] ABSTRACT

A tissue paper case includes a case body having a lifting plate urged upwardly by a spring and adapted to allow a stack of tissue paper sheets to be placed thereon and a lid member formed substantially in the shape of a gable roof having a peak and provided along the peak with a takeout hole and in the intermediate portion thereof with an undercut portion, whereby the tissue paper sheet which is partly drawn out from the takeout hole is supported in an upwardly projecting state so as to facilitate successively removing the tissue paper sheets one by one.

1 Claim, 2 Drawing Sheets

TISSUE PAPER CASE HAVING AN INCLINED LID MEMBER WITH CONCAVE UNDERCUT PORTIONS TO GUIDE THE FINGERS OF A USER

This application is a continuation of now abandoned application Ser. No. 07/101,200 filed on Sept. 25, 1987.

BACKGROUND OF THE INVENTION

1. Field of the Invention

This invention relates to a container or case for tissue paper sheets. More particularly, this invention relates to a tissue paper case having a lid member with a takeout hole from which the tissue paper sheets are permitted to be easily taken out successively one by one.

2. Description of the Prior Art

For example, in giving a permanent wave treatment to hair, tissue paper is wound on a strand of hair. Thus, the tissue paper is widely used in not only a beauty parlor, but also homes for various purposes. A conventional tissue paper case is disclosed in Japanese Patent Application Public Disclosure SHO No. 59-105404(A). This known tissue paper case comprises an inner rest on which a number of tissue paper sheets are placed and an outer cover with which the inner rest is telescopically covered so as to hold down the tissue paper sheets stacked on the inner rest under the weight of the outer cover. The outer cover has a takeout port at its upper wall, from which the tissue paper is allowed to be taken out, and a paper guide member composed of opposite plates extending upwardly from the opposite opening edges of the takeout port.

As a result of the tests of actual use of the tissue paper case described, it has been found that the condition in which the tissue paper can be easily taken out depends on the structure of the takeout port formed in the upper cover. Namely, tissue paper sheets placed on the inner rest are generally folded down the middle and the folded paper sheets are serially connected to one another in such a state that each half of the folded paper sheets is held between the leaves of the adjacent folded paper sheets. Therefore, in the case where the takeout port from which the tissue paper is taken out is formed at the center of the upper wall of the outer cover, about a quarter or more of the tissue paper should come out of the upper cover in order to be smoothly drawn out. Therefore, a paper guide member capable of holding the quarter part of the tissue paper in a stacked state is necessary.

In this conventional tissue paper case, however, the paper guide member will form a dangerous obstruction and is awkward in appearance, and the telescopic structure of the inner rest and the outer cover results in a large overall size during service.

SUMMARY OF THE INVENTION

An object of the invention is to provide a tissue paper case which allows tissue paper contained therein to be easily and smoothly taken out and which has a simple structure.

The object of the invention is attained by the provision of a tissue paper case from which two-folded tissue paper sheets serially connected to one another can be taken out successively one by one, which comprises a case body for accommodating tissue paper sheets, and a lid member detachably fitted over the opening of the case body, which lid member is formed substantially in the shape of a gable roof, having a peak and provided along the peak with a takeout hole or slot and at the middle portion of the peak thereof with a generally U-shaped undercut portion.

The tissue paper sheets within the case body are raised by means of a lifting member urged upwardly by a spring. Once the tissue paper is drawn out of the tissue paper case through the takeout hole formed in the lid member, the subsequent tissue paper protrudes somewhat from the takeout hole formed in the undercut portion of the lid member. The part of the tissue paper protruding from the takeout hole is supported in an upwarding projecting state, and therefore, can be easily held between one's fingers to be drawn out.

The above and other objects, features and advantages of the present invention will become more apparent from the following detailed description taken with the accompanying drawings.

DETAILED DESCRIPTION OF THE PREFERRED EMBODIMENT

Figure 3:
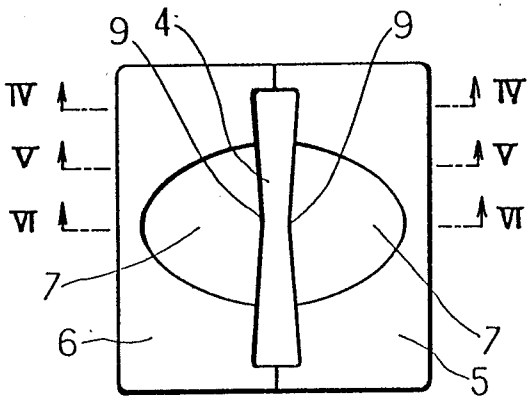
FIG. 3 is a plan view of the lid member of the tissue paper case of the present invention.
Figure 4:
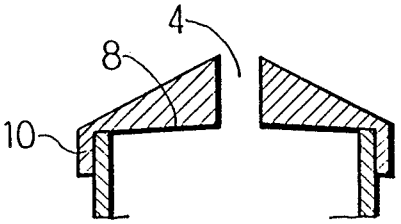
FIG. 4 is a cross-sectional view taken along line IV—IV in FIG. 3.
Figure 5:
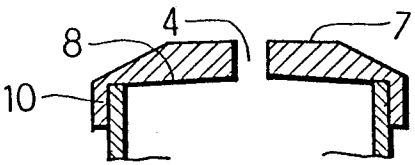
FIG. 5 is a cross-sectional view taken along line V—V in FIG. 3.
Figure 6:
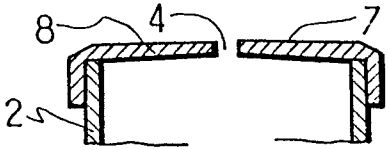
FIG. 6 is a cross-sectional view taken along line VI—VI in FIG. 3.
Figure 1:
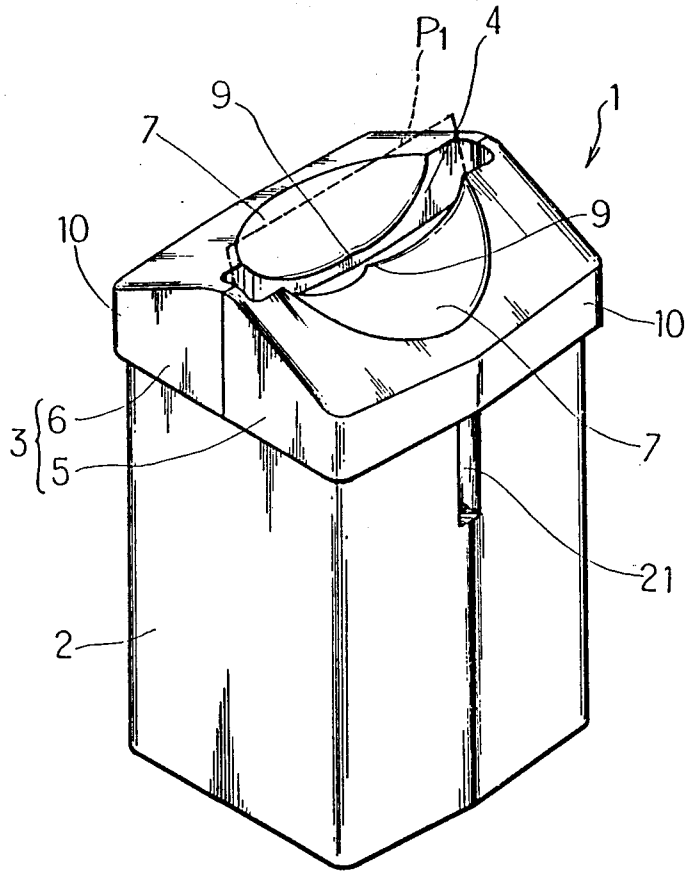
FIG. 1 is a perspective view schematically illustrating one embodiment of the tissue paper case according to the present invention.
Figure 2:
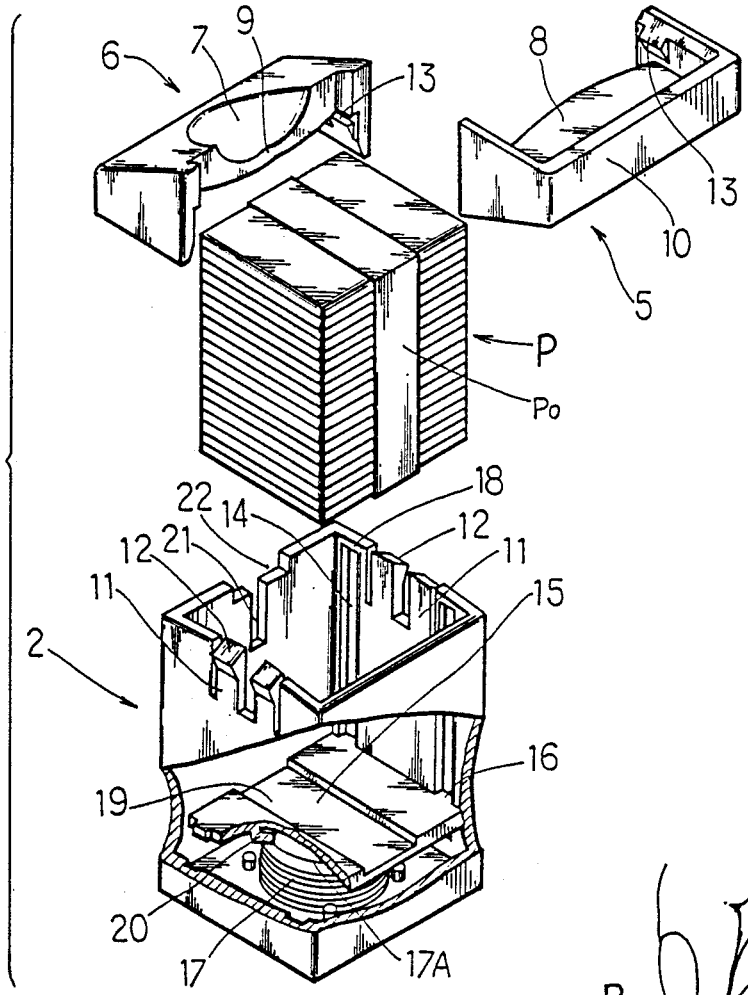
FIG. 2 is an exploded perspective view of the same.

A tissue paper case 1 according to the present invention comprises a case body 2 and a lid member 3 having an upper surface slanted slightly like a gable roof having a peak. The tissue paper case 1 is formed in the shape of a box. The gable roof-like lid member 3 has a takeout hole or slot 4 formed along the peak thereof.

In this embodiment, the lid member 3 is composed of a pair of lid halves 5, 6 between which the takeout hole 4 is defined. That is, the opposite side surfaces of the lid halves are recessed so that the takeout hole 4 is formed therebetween when the lid halves are joined to each other. The lid member 3 is provided in the middle portion of the peak thereof with a generally U-shaped undercut portion 7. As a result, there are formed raised portions at the both end portions of the peak of the lid member 3. Thus, the opening of the takeout hole 4 is curved along the curved surface of the generally U-shaped undercut portion 7, that is to say, it has the greatest depth at the middle portion of the length and gradually decreasing depth toward the opposite ends thereof in the undercut portion 7. The lower surface 8 of the lid member 3 is slightly inclined in a generally inverted-V shape. Namely, the lower surface 8 has the largest height at the middle portion thereof along the lower opening of the takeout hole 4 so that the inner height from the bottom of the case body 2 to the lower surface 8 of the lid member 3 gradually decreases from the center at which the lower opening of takeout hole 4 is located to both side ends. The takeout hole 4 is narrower at the middle of the length thereof to form restricting portions 9 projecting inwardly from the both walls defining the hole 4.

With this structure, once the uppermost of the tissue paper sheet contained within the case 1 is drawn out through the takeout hole 4, the second successive tissue paper sheet is partly drawn out of the case, because the two-folded tissue paper sheets are serially connected to one another. Thus, the part P1 of the tissue paper P which is drawn out is supported in an upwardly projecting state by raised portions at both end portions of the peak of the lid member 3. The middle of the upwardly projecting part P1 of the tissue paper is exposed owing to the undercut portion 7 so that the user can readily hold the tissue paper between his fingers and take it out.

The lid member 3 has a peripheral wall 10 which is provided on the opposite surfaces thereof with engaging catches 13 projecting inwardly. On the other hand, the case body 2 has tongue members 11 which are formed by cutting the upper edge portions to form slits and provided at their upper end portions with catches 12 projecting outwardly. When the lid member 3 is fitted to the case body 2, the engaging catches 13 on the peripheral wall 10 are brought into mutual engagement with the catches 12 provided on the tougue members 11 of the case body 2, thus mutually uniting the case body 2 and the lid member 3.

Within the case body 2, there is slidably mounted a lifting plate 15. The lifting plate 15 has guide pieces 16 projecting sidewise from the four corners thereof. The guide pieces 16 of the lifting plate 15 are slidably guided by guide recesses 14 formed in the inner opposite surfaces of the case body 2. The guide recesses 14 are terminated by stopper portions 18 at the upper edges of the case body 2. The lifting plate 15 is urged upwardly by a spring 17 and retained by the stopper portions 18 in its normal condition. The lifting plate 15 is provided in its upper surface with a groove 19 which preferably extends in the direction crosswise with respect to the takeout hole 4. The spring 17 has a fixing member 17A which is held in position by a projection 20 on the lower surface of the lifting plate 15.

In the drawings, reference numeral 21 denotes a longitudinal window for permitting observation of the amount of tissue paper sheets stacked on the lifting plate 15 within the case body 2. By 22 is denoted a finger hole which is formed between the coupled lid member 3 and case body 2. When the tissue paper sheets are placed into the case 1, the user inserts his finger into the case 1 through the finger hole 22 so as to cause the uppermost sheet of the tissue paper sheets to be pushed out of the case through the takeout hole 4.

Figure 7:
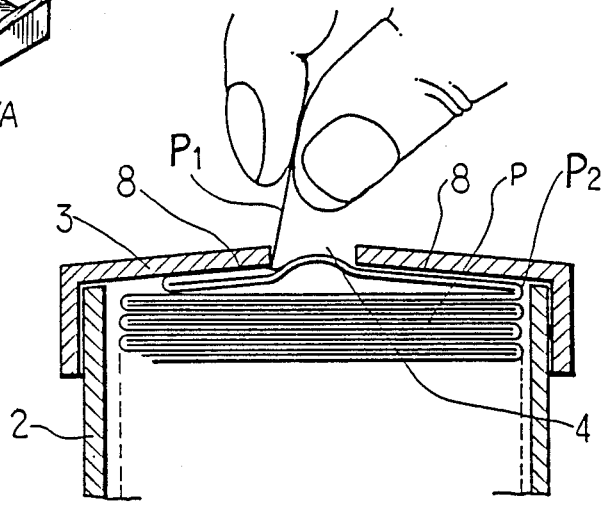
FIG. 7 is an explanatory view of the state in which tissue paper is drawn out of the tissue paper case of the present invention.

Reference symbol P designates a stack of tissue paper sheets, p individual sheets, P1 half parts into which uppermost sheet is folded, P2 half parts into which the second successive sheet is folded. As illustrated in FIG. 7, the adjacent folded sheets in the stack of sheets are arranged alternatively in direction in such a state that the half parts of the respective sheets intervene between the half parts of the adjacent sheets.

At the outset, the tissue paper sheets which are tied up in a bundle by a paper belt Po are placed on the lifting plate 15. The paper belt Po may be removed when the bundle of tissue paper sheets is thrust downward together with the lifting plate 15 against the spring 17. The paper belt Po can be removed smoothly owing to the groove 19 formed in the upper surface of the lifting plate 15. Thereafter, the lid member 3 is fitted to the case body 2 and held in position by means of the engaging catches 12 and 13 formed on the lid member and the case base. In this condition, the tissue paper sheets placed on the lifting plate 15 are raised upwardly by the spring 17 to bring the uppermost sheet of the stack of tissue paper sheets into contact with the inverted-V shaped lower surface 8 of the lid member 3. Then, the user inserts his finger into the case through the finger hole 22 formed in the peripheral wall of the case body 2 in order to cause the leading end of the uppermost sheet to project from the takeout hole 4 formed in the lid member 3. Once the uppermost sheet is partly drawn out of the case through the takeout hole 4, the tissue paper sheets can be successively taken out one by one, because the two-folded sheets are serially connected to one another. Since the drawn-out part of the uppermost sheet is supported in an upwardly projecting state by the upright walls inside the takeout hole 4 at both end portions of the peak of the lid member 3 and the erected part of the uppermost sheet of the stacked sheets is exposed in the undercut portion 7, the sheet can be readily held between one's fingers as illustrated in FIG. 7. Besides, the drawn-out part of the sheet is maintained in the upwardly projecting state by means of the restricting portions 9 projecting inwardly in the takeout hole 4. In the course of drawing out the uppermost sheet P1, the first half part of the subsequent sheet P2 gradually rises in the middle thereof along the inverted-V shaped lower surface 8 of the lid member 3, and consequently, the leading end part of the sheet P2 is drawn out without fail when the sheet P1 is completely taken out of the case 1. The lifting plate 15 is elevated with a decrease in the amount of the sheets supported thereon by means of the spring 17.

Otherwise, the tissue paper sheets may be contained within the case 1 in the following manner.

After the tissue paper sheets are placed on the lifting plate 15, they are held down by one hand of the user, and then, one of the lid halves 5 and 6 is fitted to the case body 2. Thereafter, the aforesaid one hand of the user is released and the other lid half is fitted to the case body 2 as the tissue paper sheets are retained against the spring 17 by the aforesaid one lid half, thereby to squeeze the tissue paper sheets into the case. The removal of the paper belt Po is carried out in the same way as mentioned above.

The structure of the lid member 3 composed of the lid halves 5, 6 is not indispensable to the present invention. Namely, the lid member 3 may of course be modified in design, for example, integrally molded in one body from a plastic material. Also, the peripheral wall 10 of the lid member 3 may be modified in design or omitted.

As is readily understood from the above, the tissue paper case according to the present invention permits the tissue paper sheets contained therein to be successively taken out smoothly one by one because the leading end portion of the sheet to be drawn out of the case is held in an upwardly projecting state by the upright walls defining the takeout hole formed in the lid member and assumes a partly exposed state due to the undercut portion formed in the upper surface of the lid member so that the sheet can be easily held between the fingers of the user.

Although a particular embodiment is described herein above, it is apparent to those skilled in the art that this embodiment can be modified without departing from the spirit of this invention.

What is claimed is:

1. A case for sheets of tissue paper, comprising:

an open-topped case body for accommodating a plurality of folded sheets of tissue paper therein;

a lifting plate slidably mounted in the body for movement upwardly therein, and a spring means engaged with said lifting plate for urging said plate upwardly; and a lid member detachably fitted onto the top of said case body and having a gabled roof shape with an upper surface inclined upwardly to a peak and an under surface inclined at a smaller angle than the upper surface, said lid member having along the peak a takeout hole elongated in the direction of the length of the peak and having a width at the middle of the length thereof which is less than at the opposite ends to form restricting portions projecting inwardly into said takeout hole, said restricting portions being inflexibly formed on said lid member, and said lid member having opposed undercut portions extending transversely of the peak having a concavely curved surface with a generally U-shaped cross section parallel to the length of said takeout with the part having the greatest depth opening into said takeout hole at the position of said restricting portions and said undercut portions having outermost opposite ends extending to a position on said upper surface substantially corresponding to the walls of the case body and said undercut portions extending progressively deeper into said lid member in a direction toward said takout hole to provide recesses through which fingers of a user can be moved to grasp a sheet of tissue paper in said takeout hole.

* * * * *